US009125480B2

(12) United States Patent
Guido

(10) Patent No.: US 9,125,480 B2
(45) Date of Patent: Sep. 8, 2015

(54) FOLDING BARBECUE GRILL BRUSH

(71) Applicant: Michael Anthony Guido, Smithtown, NY (US)

(72) Inventor: Michael Anthony Guido, Smithtown, NY (US)

( * ) Notice: Subject to any disclaimer, the term of this patent is extended or adjusted under 35 U.S.C. 154(b) by 0 days.

(21) Appl. No.: 14/154,687

(22) Filed: Jan. 14, 2014

(65) Prior Publication Data

US 2014/0196232 A1 Jul. 17, 2014

Related U.S. Application Data

(60) Provisional application No. 61/751,992, filed on Jan. 14, 2013.

(51) Int. Cl.
*A46B 5/00* (2006.01)
*A46B 9/02* (2006.01)

(52) U.S. Cl.
CPC ..... *A46B 5/0045* (2013.01); *A46B 5/002* (2013.01); *A46B 9/028* (2013.01)

(58) Field of Classification Search
CPC ..... A46B 5/002; A46B 5/021; A46B 2200/3093; A46B 5/0045; A46B 9/028
USPC ..... 15/143.1, 144.1, 144.2, 144.3, 144.4
See application file for complete search history.

(56) References Cited

U.S. PATENT DOCUMENTS 2,879,532 A 3/1959 Szabo et al.
3,113,335 A 12/1963 Baicker
3,937,584 A * 2/1976 Freeman ..... 403/256
4,516,870 A 5/1985 Nakazato
5,255,406 A 10/1993 Rood
5,373,600 A 12/1994 Stojanovski et al.
5,479,673 A 1/1996 Carton
D375,816 S * 11/1996 Long-Langworthy ..... D28/7
5,735,014 A 4/1998 Noga
5,771,535 A * 6/1998 Blessing ..... 16/430
6,023,810 A 2/2000 Gessert
6,049,935 A 4/2000 Zemel
6,189,222 B1 * 2/2001 Doyle ..... 30/531
6,199,245 B1 * 3/2001 Blessing ..... 16/430
6,216,306 B1 4/2001 Esterson et al.
6,276,023 B1 8/2001 Grundy
6,438,784 B1 8/2002 Yu
6,443,646 B1 9/2002 MacDonald
6,632,195 B1 * 10/2003 Smith ..... 604/36
6,709,529 B1 * 3/2004 Mekwinski ..... 134/6
6,745,428 B2 6/2004 MacLean
6,966,094 B1 11/2005 Rigakos
7,039,983 B1 5/2006 Outlaw
7,047,590 B2 5/2006 Neal et al.
7,168,124 B2 * 1/2007 Dalias ..... 15/160

(Continued)

*Primary Examiner* — Monica Carter
*Assistant Examiner* — Michael Jennings
(74) *Attorney, Agent, or Firm* — F. Chau & Associates, LLC; Sean R. Wilsusen, Esq.

(57) ABSTRACT

Provided is a barbecue grill brush including a cleaning head. The barbecue grill brush includes a straight handle. A first end of the straight handle is coupled to the cleaning head and a second end of the straight handle is coupled to a hinge. The barbecue grill brush includes a curved handle. A first end of the curved handle is coupled to an opposite side of the hinge from the straight handle, and the hinge is configured to rotate the curved handle with respect to the straight handle. A first handle grip disposed adjacent to the first end of the curved handle, and a second handle grip disposed at a second end of the curved handle. The second end of the curved handle is opposite to the first end of the curved handle.

11 Claims, 6 Drawing Sheets

(56) References Cited

U.S. PATENT DOCUMENTS

| | | | | |
|---|---|---|---|---|
| 7,275,278 | B1 | 10/2007 | Martin et al. | |
| 7,632,033 | B2 | 12/2009 | Wales | |
| 7,716,775 | B2 | 5/2010 | DiPietro et al. | |
| 7,909,526 | B2 | 3/2011 | Wales | |
| 8,032,974 | B2 | 10/2011 | Carpenter | |
| 8,202,016 | B2 | 6/2012 | Wales | |
| 8,225,451 | B2 * | 7/2012 | Weinberger et al. | 15/111 |
| 2002/0178523 | A1 | 12/2002 | Kahler et al. | |
| 2005/0011029 | A1 * | 1/2005 | Yu | 15/111 |
| 2006/0207042 | A1 * | 9/2006 | Di Paolo | 15/111 |
| 2008/0052856 | A1 * | 3/2008 | Lin | 15/172 |
| 2008/0066244 | A1 * | 3/2008 | Noble | 15/52.1 |
| 2008/0256732 | A1 * | 10/2008 | Donatelli et al. | 15/144.1 |
| 2009/0056748 | A1 * | 3/2009 | Wales | 134/6 |
| 2011/0185524 | A1 * | 8/2011 | Lee | 15/159.1 |
| 2011/0225755 | A1 * | 9/2011 | Carlson et al. | 15/145 |
| 2012/0167322 | A1 * | 7/2012 | Jaworski et al. | 15/144.1 |

* cited by examiner

FOLDING BARBECUE GRILL BRUSH

CROSS-REFERENCE TO RELATED APPLICATION

This application claims priority from U.S. Provisional Patent Application No. 61/751,992, filed Jan. 14, 2013, the entire contents of which are incorporated by reference.

TECHNICAL FIELD

The present disclosure relates to barbecue ("BBQ") grill brush, more particularly to a foldable, extendable barbecue grill brush with contoured bristles and a removable cleaning head.

DISCUSSION OF RELATED ART

Barbecue grill brushes are commonly used as a simple tool for cleaning the metal grates or metal cooking surfaces of barbecue grills prior to or after cooking food on the grill surface. A barbecue grill brush consists of a handle with a cleaning head containing bristles. Pressure is applied to the bristles of the brush head by pressing down on the handle over the grill surface and drawing the bristles back and forth along the barbecue grates or cooking surface to remove food particles and other debris. The food particles or debris generally falls below the cooking surface, thus leaving a relatively clean cooking surface for future food preparation.

SUMMARY

The present disclosure relates to a barbecue grill brush for cleaning the cooking surface or grates of barbecue grills using mechanical force applied through a barbecue grill brush.

In embodiments, the barbecue grill brush includes a folding handle designed to create excess leverage for the user compared with traditional straight, fixed length barbecue grill brush handles.

In embodiments, the barbecue grill brush includes a folding handle designed to allow the barbecue grill brush handle to be folded in order to provide for easy and space saving storage.

In embodiments, the barbecue grill brush includes an extendable handle designed to allow both of the user's hands to remain fully away from the cooking surface in order to prevent burns to the user's hands or skin while still maintaining superior leverage over shorter, straight handled barbecue grill brushes.

In embodiments, the barbecue grill brush includes a removable cleaning head that can be replaced while retaining the original barbecue grill brush handle for future use.

In embodiments, the barbecue grill brush cleaning head comprises a relatively wide structure with metal bristles to provide superior cooking surface contact and friction.

The barbecue grill brush cleaning head may further comprise a multiplicity of desired shapes and sizes, thus creating multiple arrangements of metal bristles to provide friction to the cooking surface.

In embodiments, the metal bristles of the barbecue grill brush cleaning head comprise a curved bristle design to increase the friction created between the metal bristles and the grilling surface.

In embodiments, the metal bristles of the barbecue grill brush cleaning head comprise a contoured or alternating, multiple length design to increase the friction created between the metal bristles and the grilling surface; particularly to increase friction along the outside edges of cooking surfaces with curved or cylindrical metal grating.

In embodiments, the barbecue grill brush alternatively includes a folding handle with forearm wrap-around band designed to create excess leverage for the user compared with traditional straight, fixed length barbecue grill brush handles using only one arm.

In embodiments, the barbecue grill brush with forearm wrap-around band includes a folding handle designed to allow the barbecue grill brush handle with forearm wrap-around band to be folded in order to provide for easy and space saving storage.

In embodiments, the barbecue grill brush includes an extendable handle with forearm wrap-around band for use with a single arm designed to allow both of the users hands to remain fully away from the cooking surface in order to prevent burns to the users hands or skin while still maintaining superior leverage over shorter, straight handled barbecue grill brushes while operating the band with only one arm.

BRIEF DESCRIPTION OF THE DRAWINGS

Various illustrative embodiments of the present disclosure are described herein with reference to the drawing, wherein.

DETAILED DESCRIPTION

Figure 1:
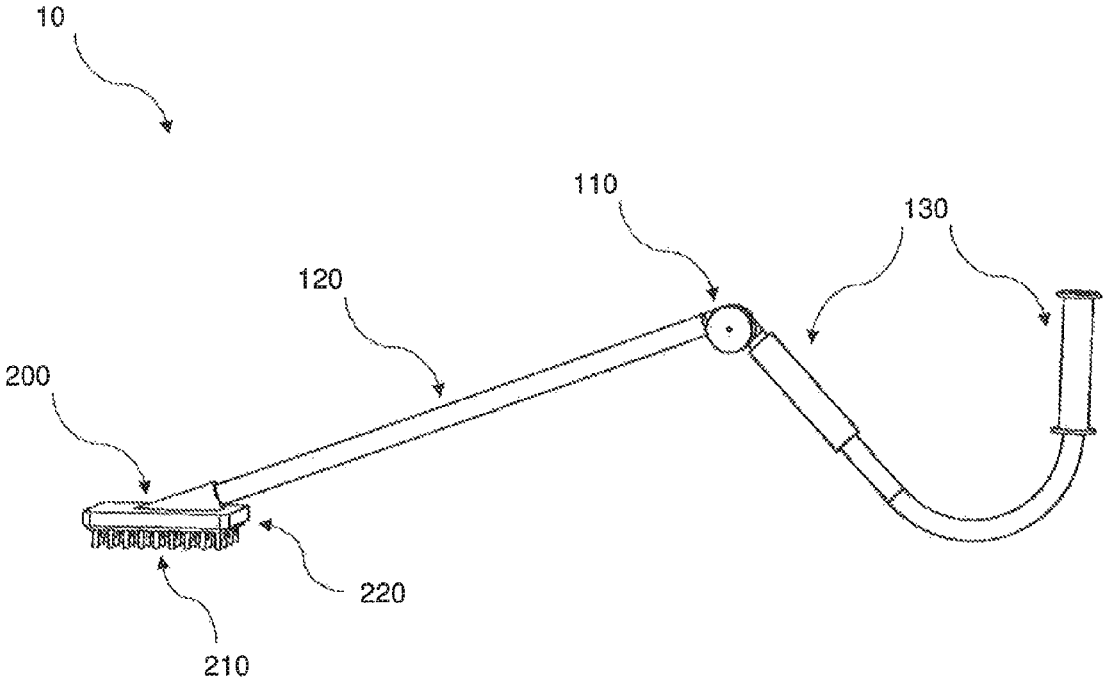
FIG. 1 is a side view of a barbecue grill brush with the handle extended according to an exemplary embodiment of the present invention.

Referring to FIGS. 1-4, a barbecue grill brush 10 in accordance with the present disclosures is shown generally including a hinge 110 with extendable handle 120 designed to create excess leverage and to avoid burns for the user compared with traditional straight, fixed length barbecue grill brush handles. The barbecue grill brush includes a plurality of handle grips 130 at the end of the brush furthest from a removable cleaning head 200. In one embodiment, the removable cleaning head 200 comprises multiple wire bristles 210. In one embodiment, the wire bristles are of alternating lengths to create a contoured shape including long wire bristles 230 and short wire bristles 240.

With continued reference to FIGS. 1-4, the extendable handle 120 can be manually adjusted for a multitude of angles through a hinge 110 to create maximal leverage and contact with a multitude of grilling surfaces (e.g. round, square, large, small), while simultaneously allowing the grill brush user to avoid placing their hands over the hot grilling surface by extending the handle to various lengths, thus avoiding the possibility of burns through heat or flame exposure. That is, although the barbecue grill brush 10 is shown in FIGS. 1-4 in one particular configuration, it is envisioned that the barbecue grill brush 10 can be adjusted for a variety of unique grilling surfaces and user preferences.

Figure 2:
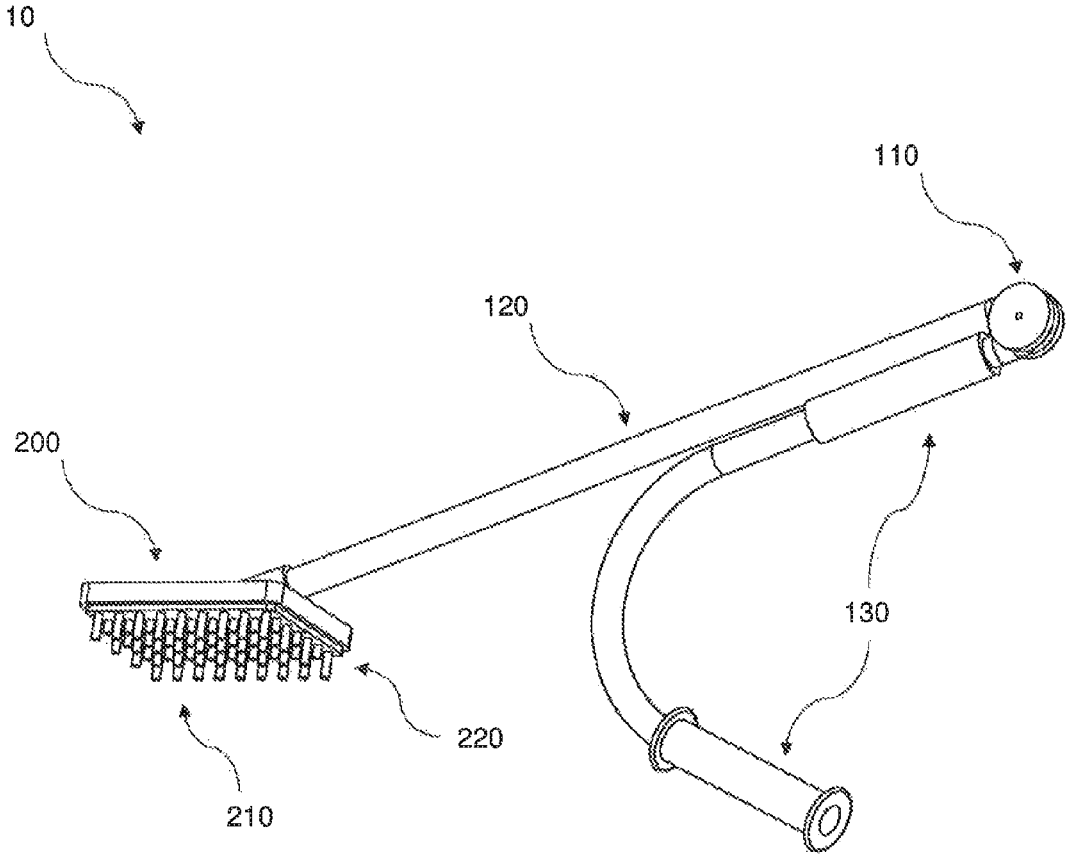
FIG. 2 is a side view of the complete barbecue grill brush of FIG. 1 with the handle folded.

Referring to FIG. 2, the barbecue grill brush 10 is shown with extendable handle 120 maximally folded via hinge 110 to allow for easy storage of the entire barbecue grill brush system 10. The hinge is configured to rotate the curved handle with respect to the straight handle to fold the first end of the curved handle against the straight handle for storage or to fold the first end of the curved handle away from the straight handle for cleaning the barbecue grill cooking surface.

Figure 3:
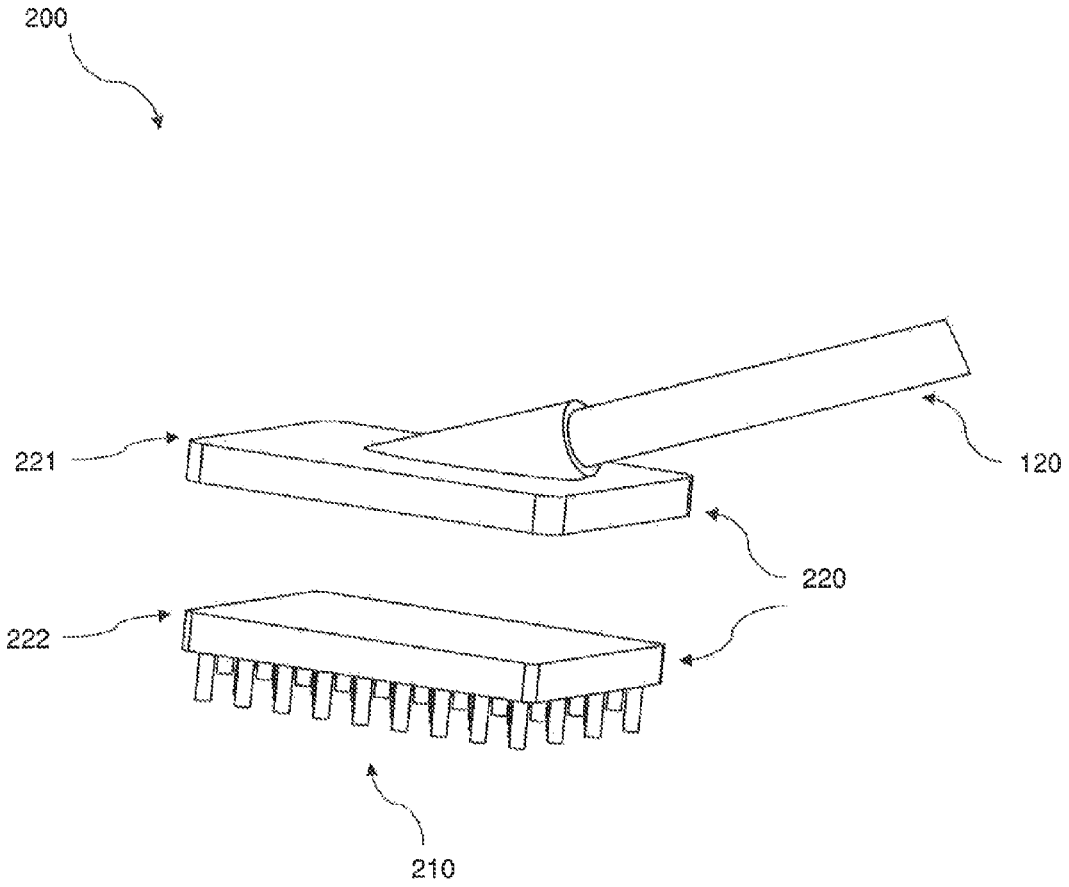
FIG. 3 is a side, close up view of the cleaning head member of the barbecue grill brush of FIG. 1 with the cleaning head removed.

Referring to FIG. 3, the barbecue grill brush cleaning head 200 at the distal end of extendable handle 120 is shown. The barbecue grill brush cleaning head 200 is comprised of a combined band 220 comprising two components that can separate to allow for removal and or replacement of replacement head 222 containing wire bristles 210. Although the barbecue grill brush cleaning head 200 is shown with component 221 remaining connected to extendable handle 120 upon removal of replacement head 222, it is also envisioned that component 221 could similarly be separated from extendable handle 120 to allow for replacement of component 221 and/or combined band 220.

Figure 4:
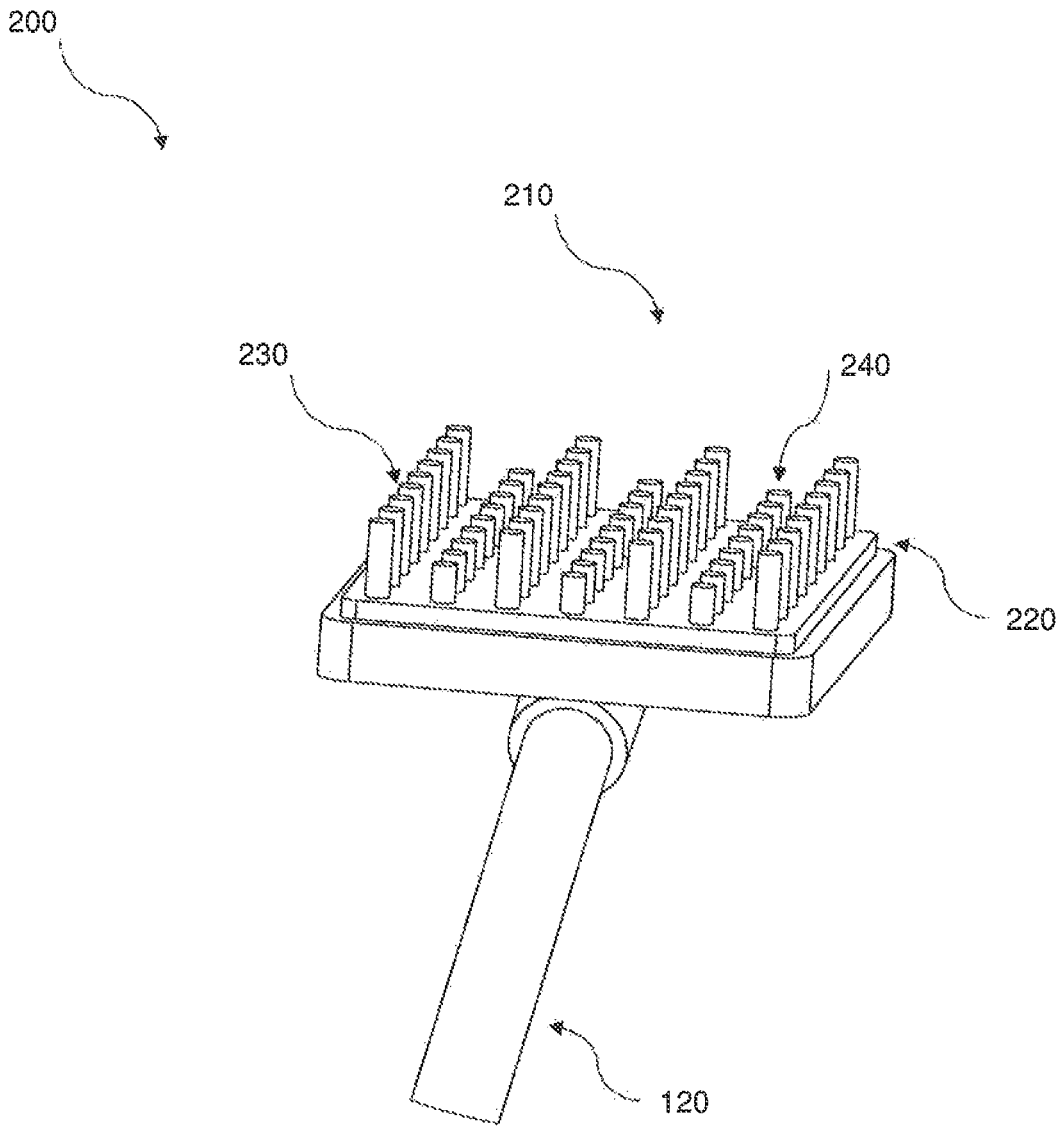
FIG. 4 is a bottom, close up view of an embodiment of the contoured, or alternating, multiple length bristles of the cleaning head member of a barbecue grill brush according to an exemplary embodiment of the present invention.

Referring to FIGS. 3-4, the barbecue grill brush cleaning head 200 at the distal end of extendable handle 120 is shown. The combined barbecue grill brush cleaning head band 220 is shown with the wire bristles 210 of replacement head 222 emphasized. The wire bristles 210 are of alternating long wire bristles 230 and short wire bristles 240. This configuration creates a contoured cleaning surface of wire bristles 210 to create maximum surface contact and therefore elevated friction between the barbecue brush cleaning head 200 and the cooking surface being cleaned.

The configuration of barbecue grill brush cleaning head 200 further allows for a relatively oversized head to create a relatively large scraping surface comprised of wire bristles 210.

Figure 5:
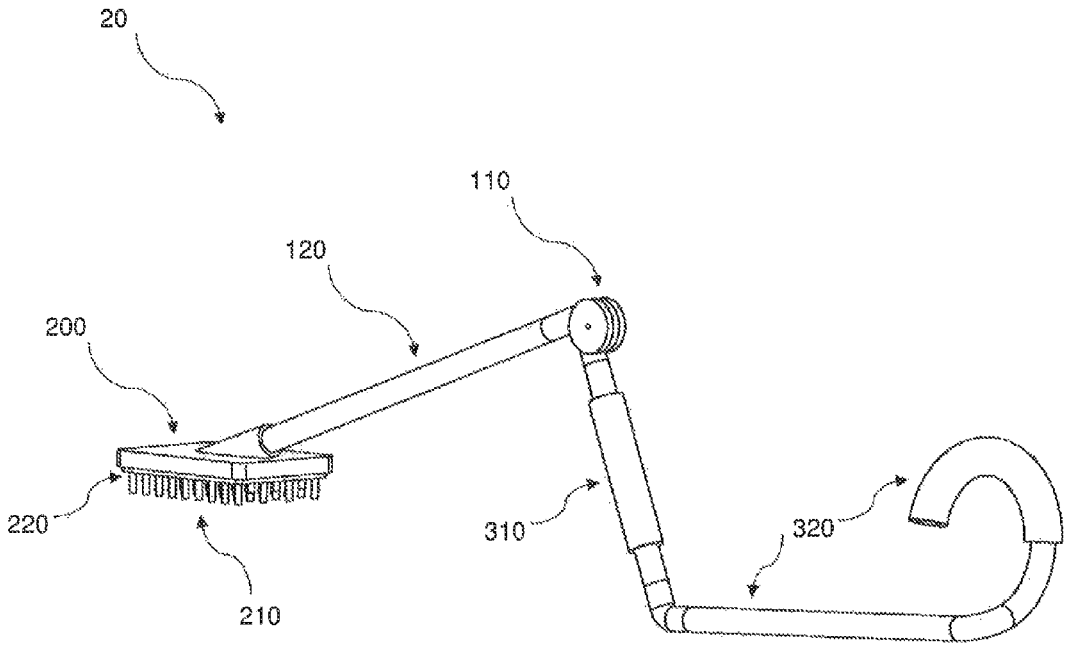
FIG. 5 is a rear angled view of a barbecue grill brush with a forearm wrap-around band with the handle extended according to an exemplary embodiment of the present invention.
Figure 6:
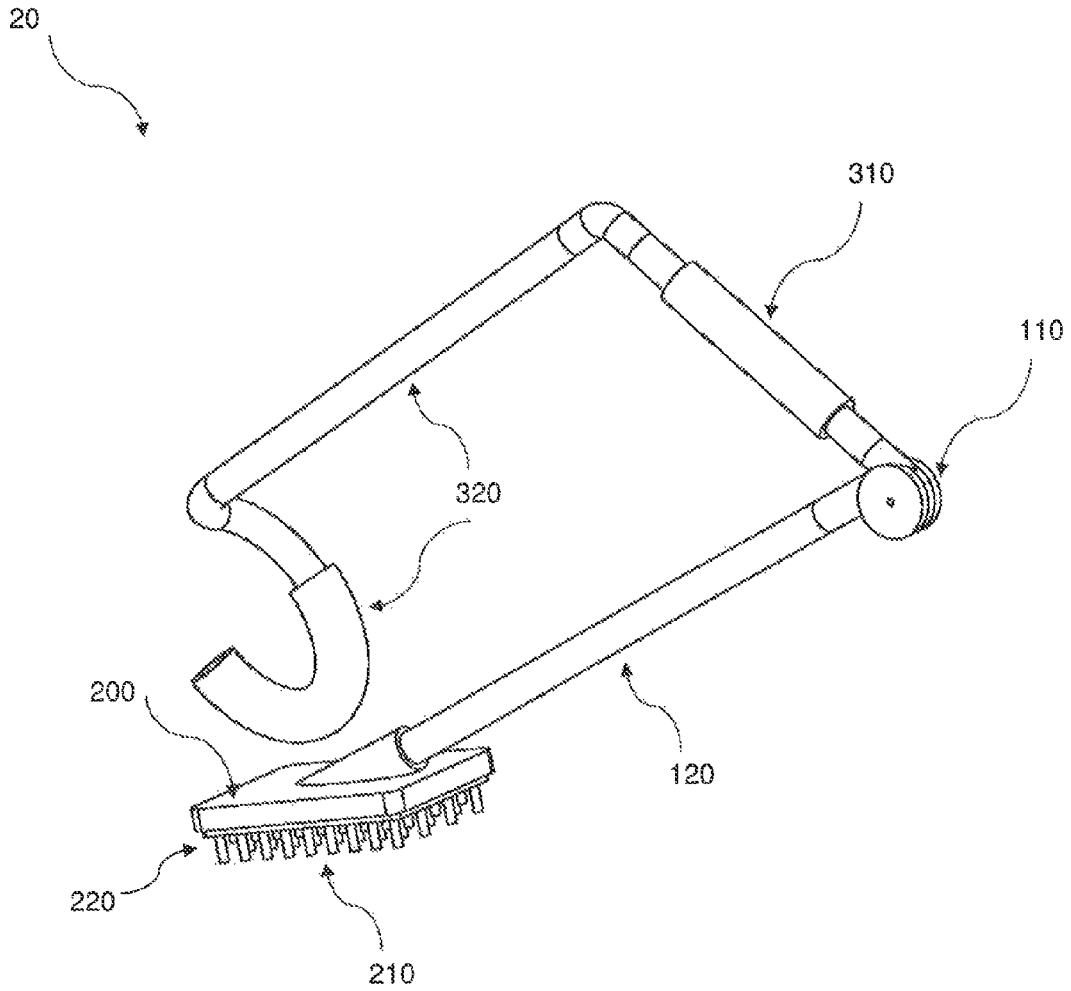
FIG. 6 is an angled side/rear view of the complete barbecue grill brush of FIG. 5 with the handle maximally folded.

Referring to FIGS. 5-6 a barbecue grill brush 20 in accordance with an exemplary embodiment is shown generally including a hinge 110 with extendable handle 120 designed to create excess leverage and to avoid burns for the user compared with traditional straight, fixed length barbecue grill brush handles. The barbecue grill brush includes a vertical handle 310 for gripping with the users hand and a forearm wrap-around band 320 at the end of the brush furthest from a removable 220 cleaning head 200 to allow for user operation with a single arm/hand while still allowing maximal downward force on the grill surface. The vertical handle includes a first handle grip comprising a front surface and a rear surface, wherein the first handle grip is disposed adjacent to the first end of the curved handle, wherein an entire portion of the front surface of the first handle grip is configured to rest flushly against the straight handle when the first end of the curved handle is folded against a straight portion of the handle (120). Further, including second handle grip disposed at a second end of the vertical handle (310), with the second end of the curved handle is opposite to the first end of the curved handle, with when the first end of the curved handle is folded away from the straight handle an upper surface of the second handle grip is configured to face in an upward direction that is opposite to the downward direction of the cleaning head.

Referring to FIG. 6, the barbecue grill brush 20 is shown with extendable handle 120 maximally folded via hinge 110 to allow for easy storage of the entire barbecue grill brush system 20.

From the foregoing and with reference to the figure drawings, those skilled in the art will appreciate that certain modifications can also be made to the present disclosure without departing from the scope of the same. Therefore, the above description should not be construed as limiting, but merely as exemplifications of particular embodiments.

What is claimed is:

1. A barbecue grill brush, comprising a cleaning head configured to face in a downward direction for cleaning a barbecue grill cooking surface;

a straight handle, wherein a first end of the straight handle is coupled to the cleaning head and a second end of the straight handle is coupled to a hinge;

a curved handle, wherein a first end of the curved handle is coupled to an opposite side of the hinge from the straight handle, and wherein the hinge is configured to rotate the curved handle with respect to the straight handle to fold the first end of the curved handle against the straight handle for storage or to fold the first end of the curved handle away from the straight handle for cleaning the barbecue grill cooking surface;

a first handle grip comprising a front surface and a rear surface, wherein the first handle grip is disposed adjacent to the first end of the curved handle, wherein an entire portion of the front surface of the first handle grip is configured to rest flushly against the straight handle when the first end of the curved handle is folded against the straight handle; and a second handle grip disposed at a second end of the curved handle, wherein the second end of the curved handle is opposite to the first end of the curved handle, wherein when the first end of the curved handle is folded away from the straight handle an upper surface of the second handle grip is configured to face in an upward direction that is opposite to the downward direction of the cleaning head.

2. The barbecue grill brush of claim 1, further comprising a plurality of wire bristles coupled to the cleaning head.

3. The barbecue grill brush of claim 2, wherein the plurality of wire bristles comprise different lengths.

4. The barbecue grill brush of claim 2, wherein the plurality of wire bristles include short wired bristles and long wired bristles and the short and long wired bristles are alternately arranged in a plurality of rows.

5. The barbecue grill brush of claim 2, wherein the plurality of wire bristles comprise a curved shape.

6. The barbecue grill brush of claim 1, wherein the cleaning head is removable.

7. The barbecue grill brush of claim 1, wherein the straight handle is configured to be extendable to a plurality of lengths.

8. The barbecue grill brush of claim 7, wherein at least one of the plurality of lengths is longer than a width of the barbecue grill cooking surface.

9. The barbecue grill brush of claim 8, wherein when the first end of the curved handle is folded away from the straight handle, the first end of the curved handle projects away from the hinge in an angled and downward direction with respect to the straight handle.

10. The barbecue grill brush of claim 9, wherein when the first end of the curved handle is folded away from the straight handle, and when the first end of the curved handle projects away from the hinge in the angled and downward direction with respect to the straight handle, the first end of the curved handle forms an angle of 90 degrees or greater with the straight handle.

11. The barbecue grill brush of claim 1, wherein the cleaning head is removable and the extendable handle is configured to be coupled to a replacement cleaning head.

* * * * *